US007918028B2

(12) United States Patent
Steigerwalt et al.

(10) Patent No.: US 7,918,028 B2
(45) Date of Patent: Apr. 5, 2011

(54) FOLDING KNIFE WITH THUMB RELEASE OPENING

(76) Inventors: Kenneth A. Steigerwalt, Orangeville, PA (US); Matthew J. Lerch, Sussex, WI (US)

( * ) Notice: Subject to any disclaimer, the term of this patent is extended or adjusted under 35 U.S.C. 154(b) by 300 days.

(21) Appl. No.: 12/196,327

(22) Filed: Aug. 22, 2008

(65) Prior Publication Data

US 2009/0133267 A1 May 28, 2009

Related U.S. Application Data

(60) Provisional application No. 60/989,997, filed on Nov. 26, 2007.

(51) Int. Cl.
*B26B 3/06* (2006.01)

(52) U.S. Cl. ..... 30/155; 30/160; 30/161

(58) Field of Classification Search ..... 30/155–161, 30/342, 2, 167, 169; 7/118–120
See application file for complete search history.

(56) References Cited

U.S. PATENT DOCUMENTS 4,535,539 A * 8/1985 Friedman et al. ..... 30/161
4,979,301 A 12/1990 Walker
5,293,690 A * 3/1994 Cassady ..... 30/161
6,957,491 B2 * 10/2005 Van Deursen et al. ..... 30/142
7,278,213 B2 * 10/2007 Pardue et al. ..... 30/160
7,293,360 B2 11/2007 Steigerwalt et al.
7,543,386 B2 * 6/2009 Sullivan ..... 30/160
7,578,064 B2 * 8/2009 Busse ..... 30/153
RE41,259 E * 4/2010 McHenry et al. ..... 30/161
7,748,122 B2 * 7/2010 Duey ..... 30/159
2005/0229401 A1 10/2005 Onion

OTHER PUBLICATIONS

Photographs of knife shown at trade show and sold in 2005.

* cited by examiner

*Primary Examiner* — Boyer D Ashley
*Assistant Examiner* — Omar Flores-Sánchez
(74) *Attorney, Agent, or Firm* — Donald J. Ersler

(57) ABSTRACT

A folding knife with thumb release opening includes a knife blade, a first liner plate, a second liner plate, a first handle plate and a second handle plate. The knife blade includes a cutting edge and a point formed on a first end. A second end of the knife blade is pivotally retained by a first end of first and second liner plates. A push button is retained in the knife blade. A liner lock is formed in the second liner plate. A lock pin is pressed into an end of the liner lock and a lock hole is formed in the second end of the knife blade to receive the lock pin. The first and second handle plates cover the first and second liner plates. The push button may be replaced with a thumb disc. A second embodiment includes spring assisted opening and a third embodiment includes automatic opening.

20 Claims, 7 Drawing Sheets

FIG, 4

FOLDING KNIFE WITH THUMB RELEASE OPENING

CROSS-REFERENCES TO RELATED APPLICATIONS

This is a utility patent application taking priority from provisional application No. 60/989,997 filed on Nov. 26, 2007.

BACKGROUND OF THE INVENTION

1. Field of the Invention

The present invention relates generally to folding knives and more specifically to a folding knife with thumb release opening for unlocking a knife blade from a closed position.

2. Discussion of the Prior Art

U.S. Pat. No. 4,979,301 to Walker discloses a locking mechanism for folding blade knife. The Walker knife patent includes a folding blade knife constructed so that the knife blade can be opened or closed with one hand. A locking lever is pivotally mounted in the elongated slot in the blade. The lever has a release button formed on one end and a locking button formed on the other end. U.S. Pat. No. 7,293,360 to Steigerwalt et al. discloses a knife blade opening mechanism. The Steigerwalt et al. patent includes an opening assist mechanism that functions to drive the blade from a closed position to an open position.

Patent application number 2005/0229401 to Onion discloses a locking mechanism for a folding knife. The Onion patent includes a folding knife with a locking mechanism. One locking mechanism is formed from a second locking element slidably mounted on the blade to engage at least part of a first locking element on the handle and lock the blade in the open position. The second locking element and blade may be configured to allow simple, one handed locking and unlocking of the blade with a single thumb-actuated motion.

Accordingly, there is a clearly felt need in the art for a folding knife with thumb release opening for unlocking a knife blade from a closed position with one hand and closing the knife blade from an open position with one hand.

SUMMARY OF THE INVENTION

The present invention provides a folding knife with thumb release for unlocking a knife blade from a closed position. The folding knife with thumb release opening (thumb release knife) includes a knife blade, a first liner plate, a second liner plate, a first handle plate and a second handle plate. The knife blade includes a cutting edge formed on at least one side and a point formed on a first end. A second end of the knife blade is pivotally retained by the first end of the first and second liner plates. A push button is retained in the knife blade at substantially the second end thereof.

A liner lock is formed in the second liner plate for retaining the knife blade in an open position. A lock pin is pressed into an end of the liner lock and a lock hole is formed in the second end of the knife blade to receive the lock pin. The lock pin and lock hole retain the knife blade in a closed position. A spacer is retained between the first and second liner plates at a second of the first and second liner plates. The first and second handle plates are retained against the first and second liner plates, respectively with fasteners. Depressing the push button causes the liner lock to move away from the knife blade and pull the lock pin out of the lock hole, which allows the knife blade to be rotated to the open position.

The push button may be replaced with a thumb disc. The thumb disc is pivotally retained at substantially the second end of the knife blade. Pivoting the thumb disc causes an edge of the thumb disc to move the liner lock away from the knife blade and pull the lock pin out of the lock hole, which allows the knife blade to be rotated to the open position.

A second embodiment of the thumb release knife includes spring assisted opening. A first spring arm is formed from a top portion of the first liner plate and a second spring arm is formed from a top portion of the second liner plate. A push cylinder is retained between ends of the first and second spring arm. The push cylinder rides in a push contour of the knife blade, such that the knife blade must be partially opened, before the first and second spring arms will exert enough force on the second end of the knife blade to provide opening assistance thereto.

A third embodiment of the thumb release knife includes automatic opening. The third embodiment of the thumb release knife includes the knife blade, the first liner plate, the second liner plate, the first handle plate and the second handle plate. A second end of the knife blade is pivotally retained by the first end of the first and second liner plates. A spring spacer is retained between the first and second liner plates at a second of the first and second liner plates. The spring causes the knife blade to rotate from a closed position to an open position, when the thumb disc is rotated.

Accordingly, it is an object of the present invention to provide a thumb release knife for unlocking a knife blade from a closed position with one hand.

Finally, it is another object of the present invention to provide a thumb release knife for closing a knife blade from an open position with one hand.

These and additional objects, advantages, features and benefits of the present invention will become apparent from the following specification.

DETAILED DESCRIPTION OF THE PREFERRED EMBODIMENTS

Figure 1:
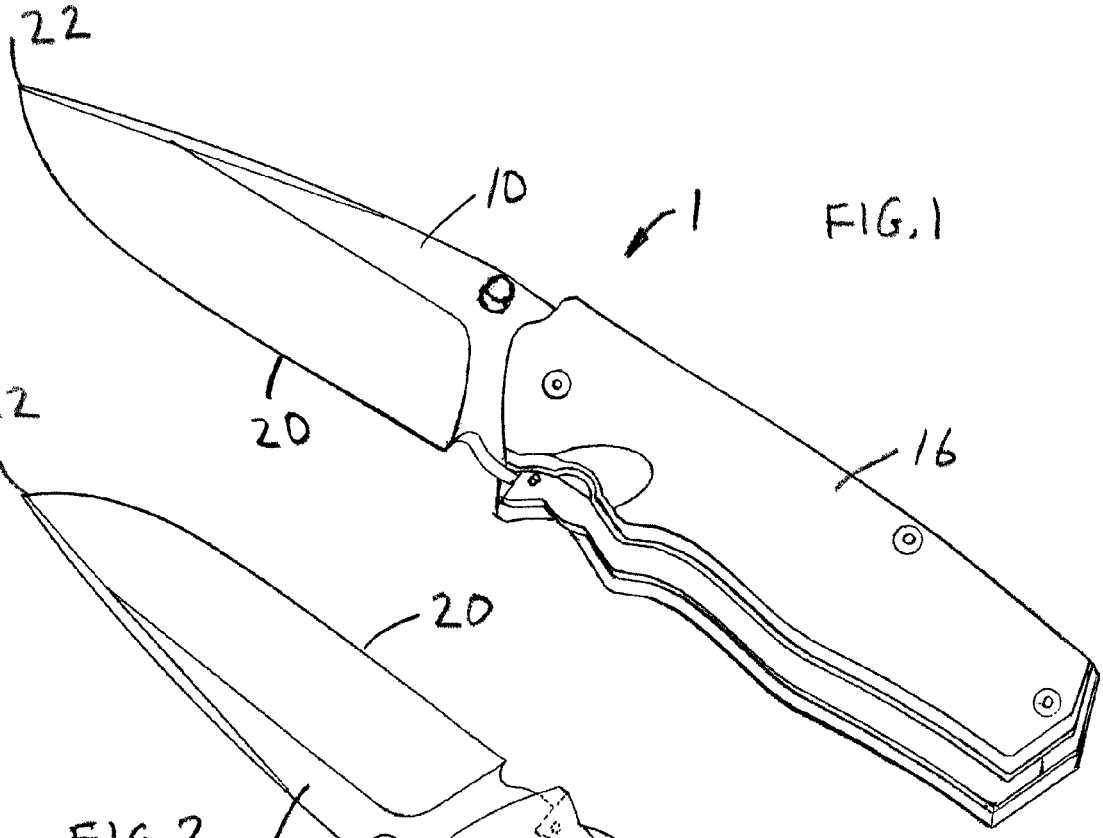
FIG. 1 is a perspective view of a thumb release knife with a knife blade in an open position in accordance with the present invention.
Figure 2:
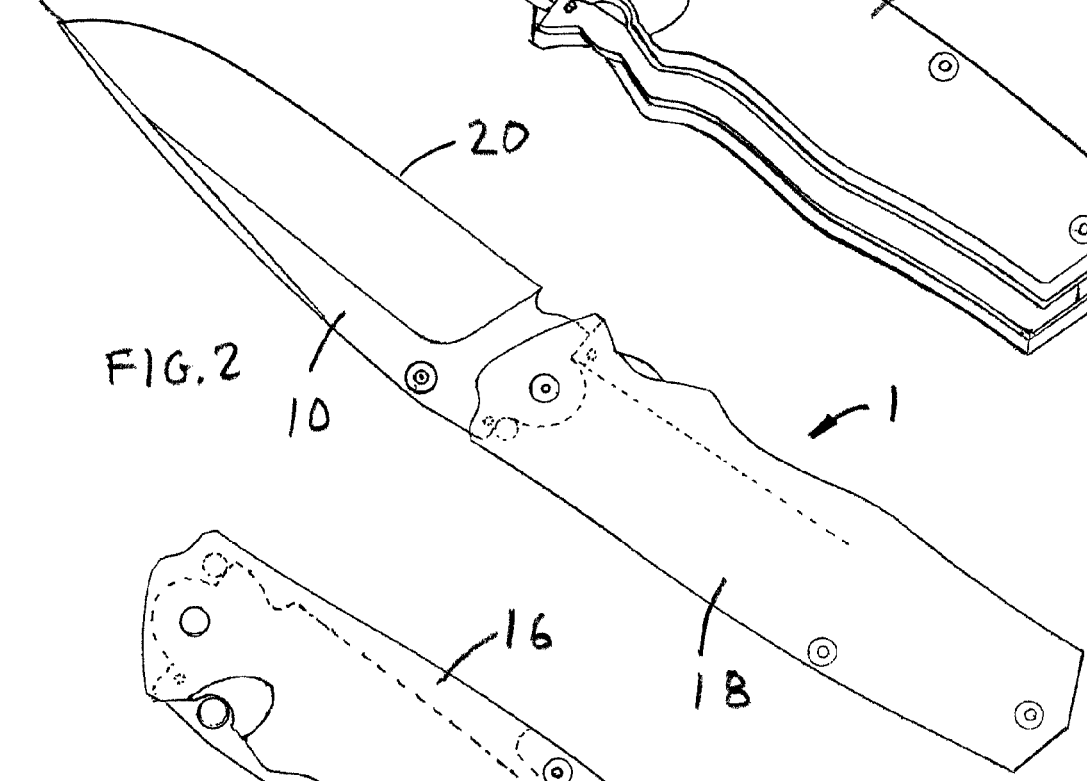
FIG. 2 is a perspective view of a thumb release knife with a knife blade in an open position rotated 180 degrees from that of FIG. 1 in accordance with the present invention.
Figure 3:
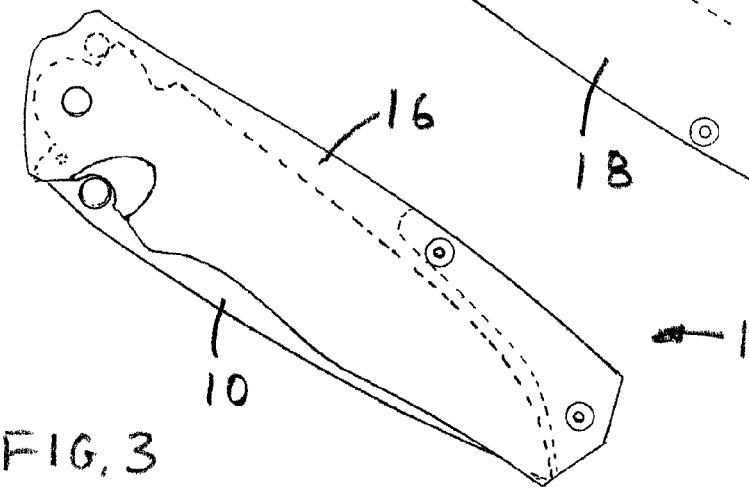
FIG. 3 is a perspective view of a thumb release knife with a knife blade in a closed position in accordance with the present invention.
Figure 4:
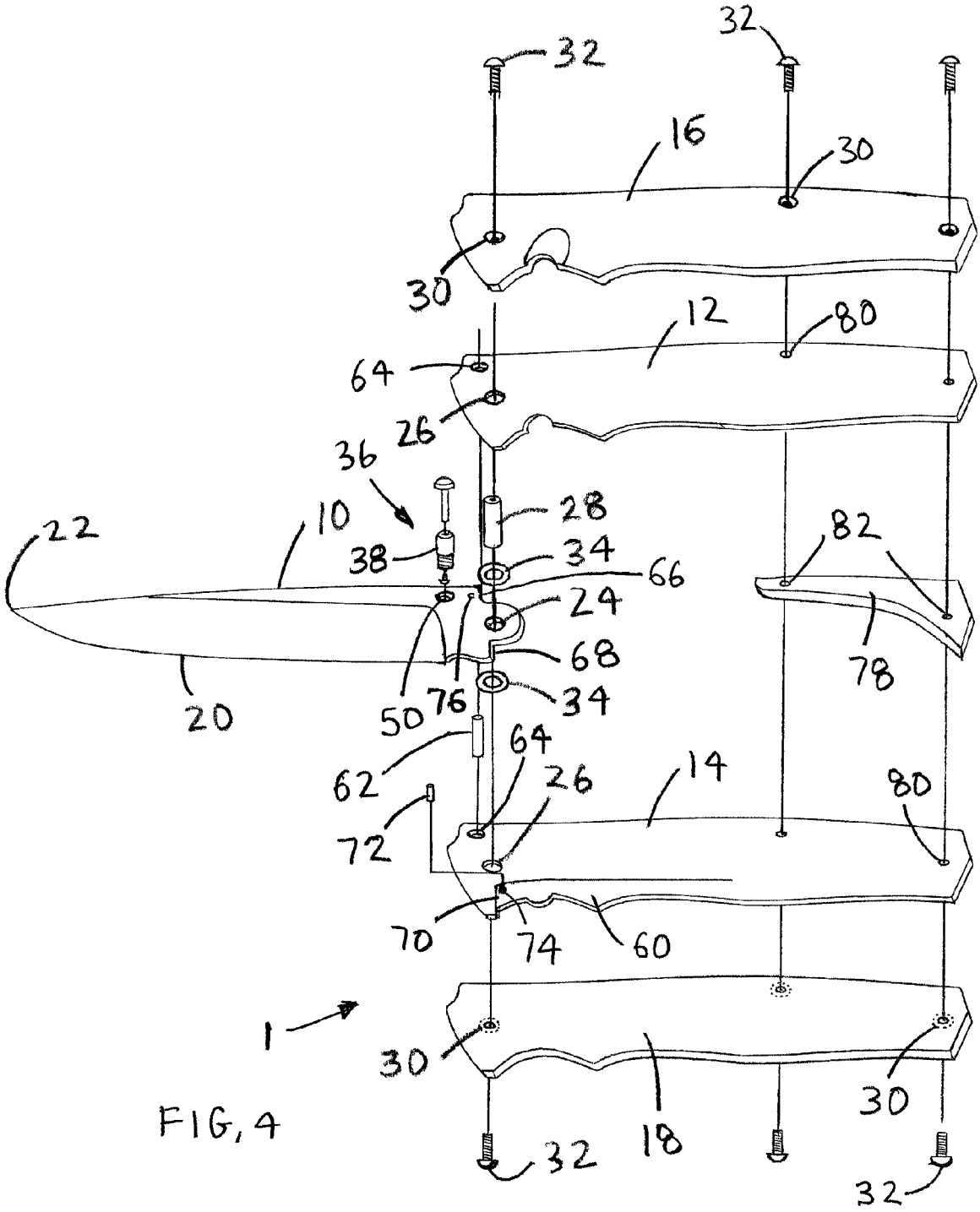
FIG. 4 is an exploded perspective view of a thumb release knife in accordance with the present invention.

With reference now to the drawings, and particularly to FIG. 1, there is shown a perspective view of a thumb release knife 1 in an open position. With reference to FIGS. 2-4, the thumb release knife 1 includes a knife blade 10, a first liner plate 12, a second liner plate 14, a first handle plate 16 and a second handle plate 18. The knife blade 10 includes a cutting edge 20 formed on at least one side and a point 22 formed on a first end. A knife pivot bore 24 is formed through a second end of the knife blade 10; and a liner pivot bore 26 is formed through a first end of the first and second liner plates to receive a pivot pin 28. At least three handle counterbores 30 are formed through the first and second handle plates to receive at least three fasteners 32. A single fastener 32 is threaded into each end of the pivot pin 28. At least one washer 34 is preferably placed on opposing sides of the knife blade 10.

Figure 15:
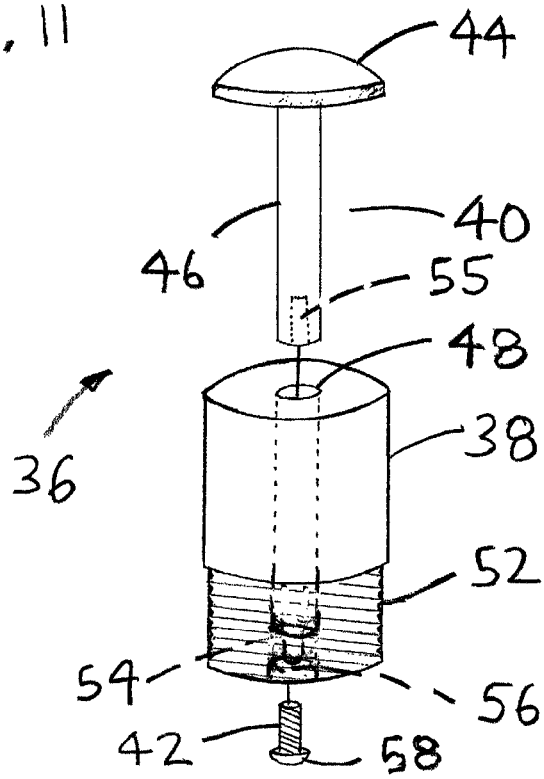
FIG. 15 is an enlarged exploded perspective view of a push button of a thumb release knife in accordance with the present invention.
Figure 16:
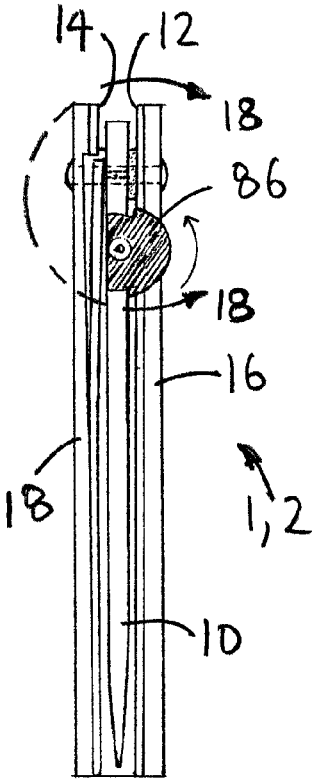
FIG. 16 is a bottom view of a thumb release knife having a thumb disc and a knife blade locked in a closed position in accordance with the present invention.
Figure 17:
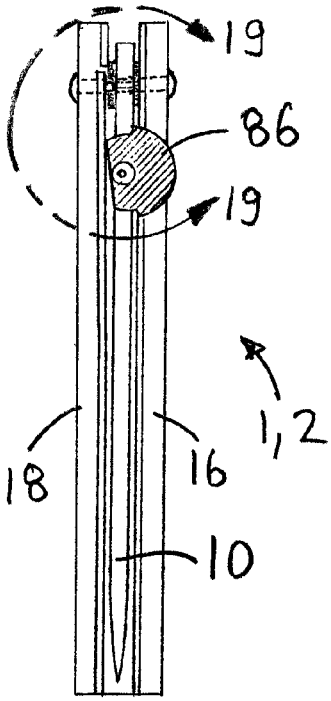
FIG. 17 is a bottom view of a thumb release knife having a thumb disc and a knife blade in a closed position and unlocked by pivoting the thumb disc in accordance with the present invention.
Figure 18:
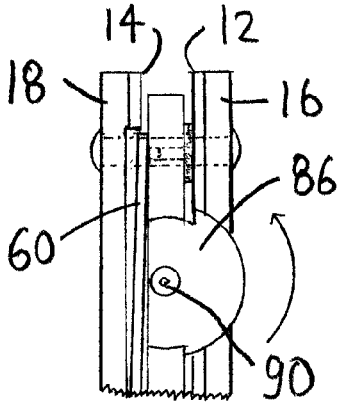
FIG. 18 is an enlarged view of a portion of FIG. 16 in accordance with the present invention.
Figure 19:
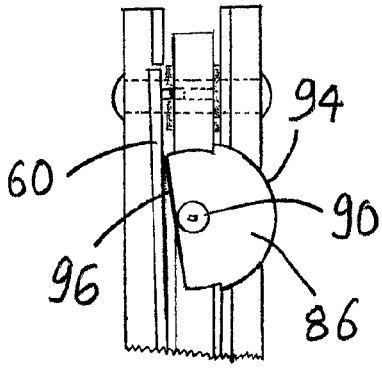
FIG. 19 is an enlarged view of a portion of FIG. 17 in accordance with the present invention.
Figure 20:
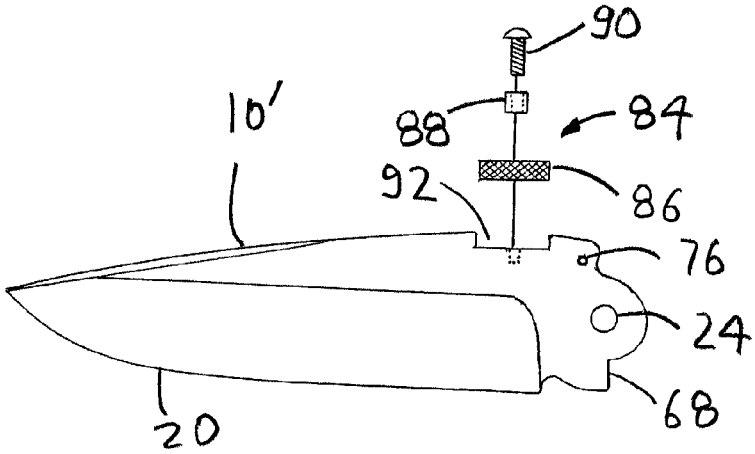
FIG. 20 is an exploded side view of a thumb disc and a knife blade of a thumb release knife in accordance with the present invention.

With reference to FIG. 15, a push button 36 includes a button base 38, an actuation rod 40 and a fastener 42. The actuation rod 40 includes a push pad 44 and a push rod 46 extending from a bottom of the push pad 44. A rod bore 48 is formed in the button base 38 to receive the push rod 46 and allow the bottom of the push pad 44 to contact a top of the button base 38. A threaded tap 50 is formed in the knife blade 10 at substantially a second end thereof to threadably receive a base thread 52 formed on a bottom end of the button base 38. A fastener clearance hole 54 and a fastener counterbore 56 are formed in the bottom end of the button base 38 to receive the fastener 42. The fastener 42 is screwed into a threaded tap 55 in an end of the push rod 46 to retain the actuation rod 40 in the button base 38.

A liner lock 60 is formed by shearing a bottom portion of the second liner plate 14. A stop pin 62 is pressed into pin holes 64 in the first and second liner plates. A stop edge 66 is formed on one side of the knife pivot bore 24 to receive the stop pin 62. A lock edge 68 is formed on the other side of the knife pivot bore 24 to receive a lock end 70 of the liner lock 60. The lock end 70 and the stop pin 62 retain the knife blade 10 in an open position. A lock pin 72 is pressed into a lock hole 74 in the end of the liner lock 60. A lock hole 76 is formed in the second end of the knife blade 10 to receive the lock pin 72 in a closed position. The lock pin 72 and the lock hole 76 retain the knife blade 10 in a closed position.

A spacer 78 is retained between the first and second liner plates at second ends of the first and second liner plates. At least four fasteners 32 are inserted through at least four handle counterbores 30 in the first and second handle plates; at least four and clearance holes 80 in the first and second liner plates; and screwed into at least two threaded taps 82 in the spacer 78.

With reference to FIGS. 11-14, a head 58 of the fastener 42 is substantially flush with a bottom of the button base 38, when the head 58 contacts a bottom of the fastener counterbore 56; a gap also exists between a top of the button base 38 and the bottom of the push pad 44. Depressing the push pad 44 causes the head 50 to push the liner lock 60 outward with the result of pulling the lock pin 72 out of the lock hole 76. With the lock pin 72 out of the lock hole 76, the knife blade 10 may be swung out of the closed position to the open position.

With reference to FIGS. 16-20, the push button 36 may be replaced with a thumb disc 84. The thumb disc 84 includes a half disc 86, a tubular spacer 88 and a fastener 90. A disc slot 92 is preferably formed in a top edge of the knife blade 10, which is sized to pivotally receive the half disc 86. A spacer bore is formed through the half disc 86 to receive the tubular spacer 88. The tubular spacer 88 is slightly longer than a thickness of the half disc 86. The fastener 90 is inserted through the tubular spacer 88 and threaded into the knife blade 10'. A curved edge 94 of the half disc 86 is preferably knurled to provide a gripping surface. A back edge 96 of the half disc 86 is preferably straight. The half disc 86 is pivoted, such that the back edge 96 forces the liner lock 60 outward.

Figure 5:
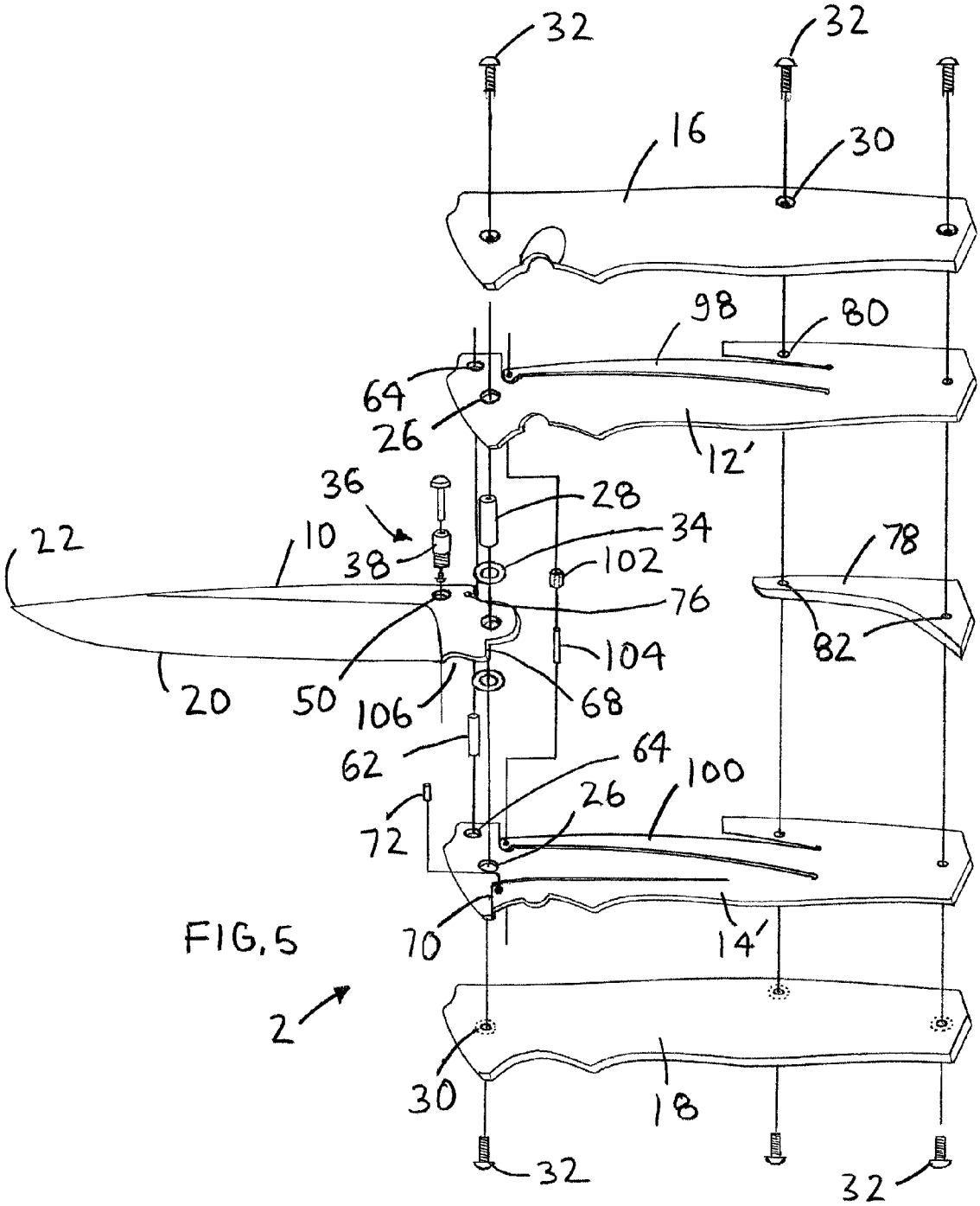
FIG. 5 is an exploded perspective view of a second embodiment of a thumb release knife in accordance with the present invention.
Figure 6:
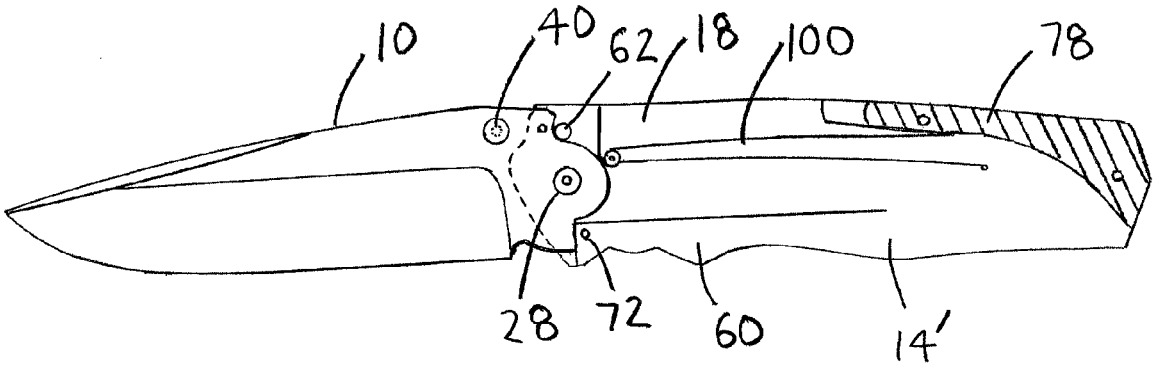
FIG. 6 is a cross sectional view of a second embodiment of a thumb release knife with a knife blade in an open position in accordance with the present invention.
Figure 7:
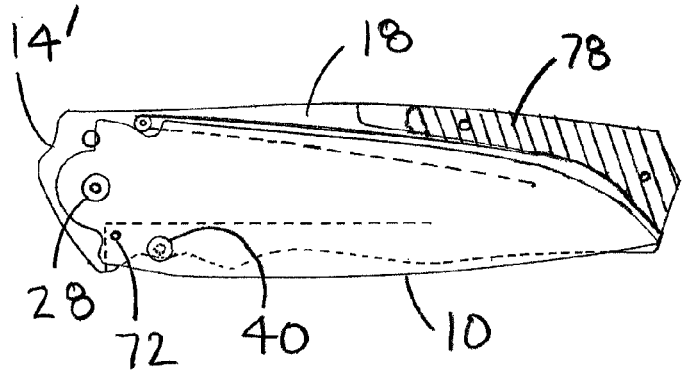
FIG. 7 is a cross sectional view of a second embodiment of a thumb release knife with a knife blade in a closed position in accordance with the present invention.

With reference to FIGS. 5-7, a second embodiment of the thumb release knife 2 includes spring assisted opening. A first spring arm 98 is formed from a top portion of the first liner plate 12' and a second spring arm 100 is formed from a top portion of the second liner plate 14'. The first and second liner plates are fabricated from a material having memory for the first and second spring arms. A push cylinder 102 is retained between an end of the first and second spring arm by inserting a retention pin 104 through the push cylinder 102 and a first end of the first and second spring arms. The push cylinder 102 rides in a push contour 106, such that the knife blade 10' must be partially opened, before the first and second spring arms will exert enough force on the second end of the knife blade 10' to provide opening assistance thereto.

The knife blade 10 of the thumb release knife 1, 2 is placed in an open position by full depressing the push pad 44 or fully rotating the thumb disc 84 with a thumb, while simultaneously pushing the push pad 44 or the thumb disc 84 away from the handle plates 16, 18.

Figure 8:
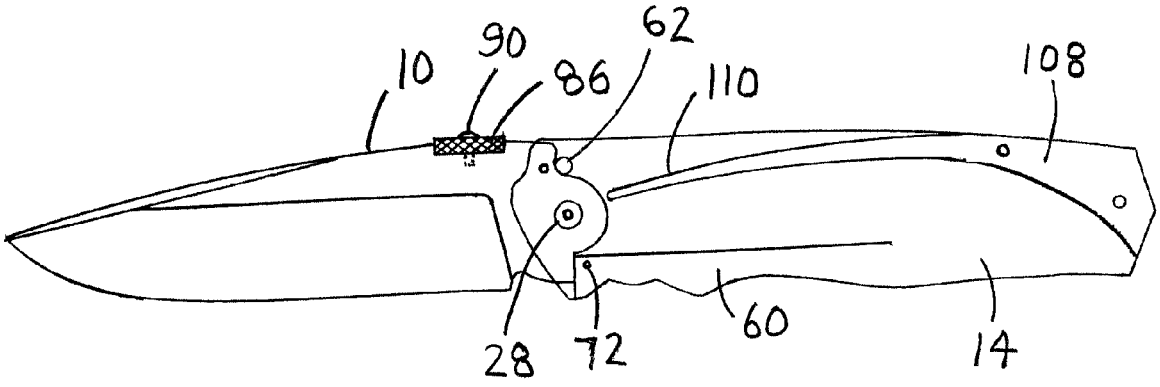
FIG. 8 is a side view of a third embodiment of a thumb release knife with a knife blade in an open position with a first handle plate and a first liner plate removed in accordance with the present invention.
Figure 9:
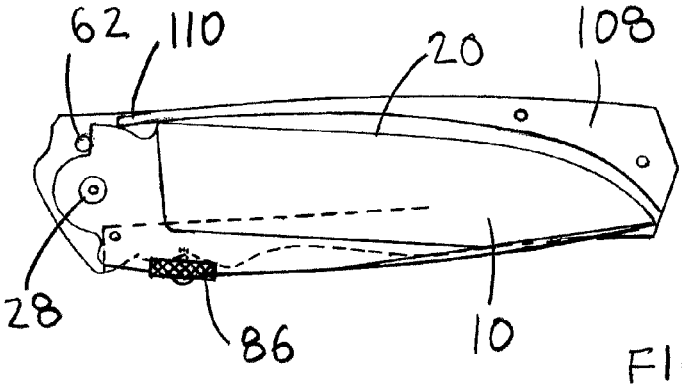
FIG. 9 is a side view of a third embodiment of a thumb release knife with a knife blade in a closed position with a first handle plate and a first liner plate removed in accordance with the present invention.
Figure 10:
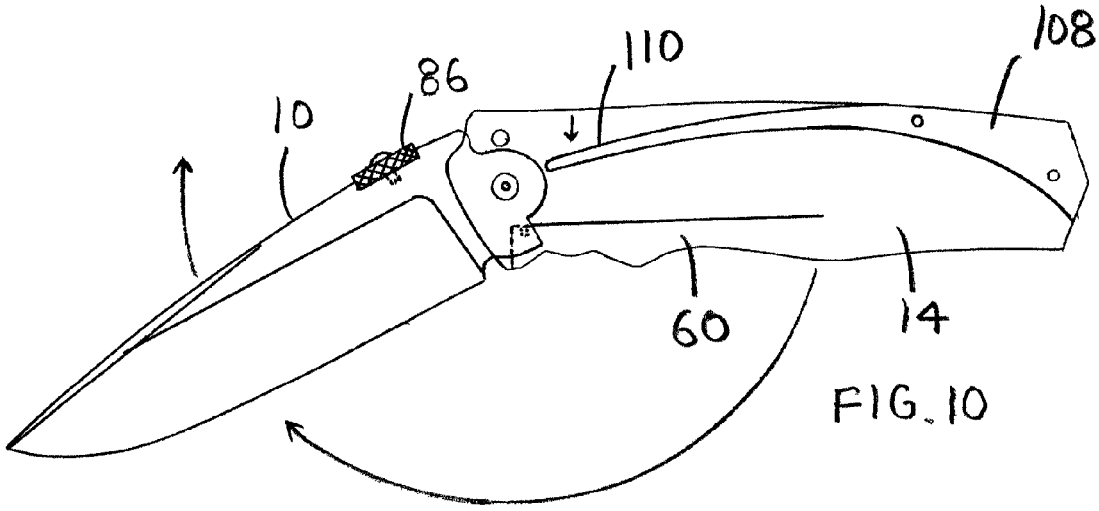
FIG. 10 is a side view of a third embodiment of a thumb release knife with a knife blade released from a closed position and moving to an open position with a first handle plate and a first liner plate removed in accordance with the present invention.
Figure 11:
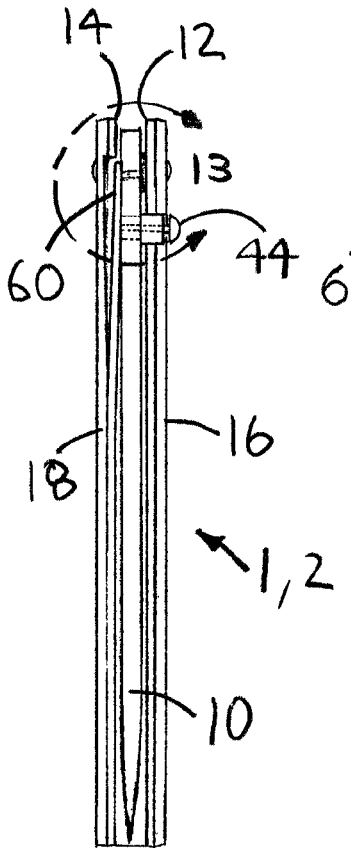
FIG. 11 is a bottom view of a thumb release knife with a knife blade locked in a closed position in accordance with the present invention.
Figure 12:
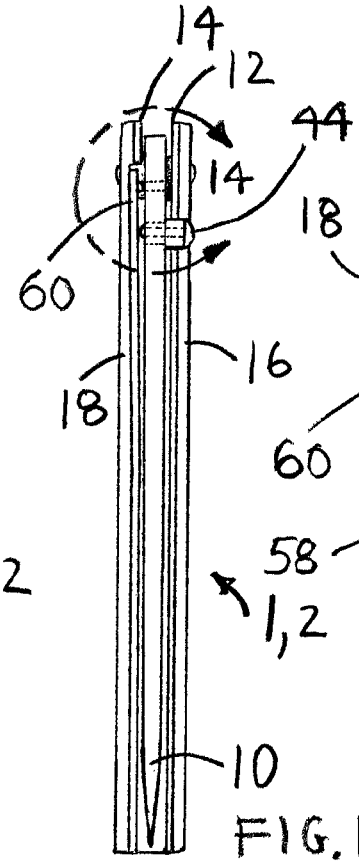
FIG. 12 is a bottom view of a thumb release knife with a knife blade in a closed position and unlocked by depression of a push button in accordance with the present invention.
Figure 13:
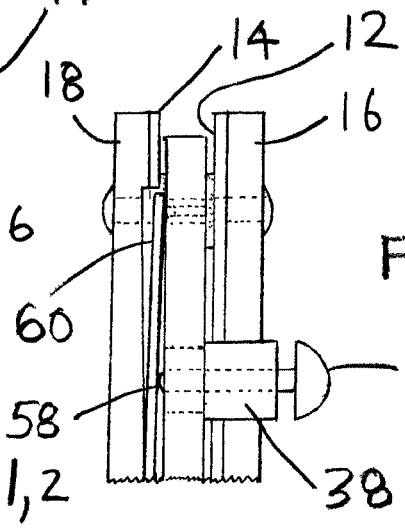
FIG. 13 is an enlarged view of a portion of FIG. 11 in accordance with the present invention.
Figure 14:
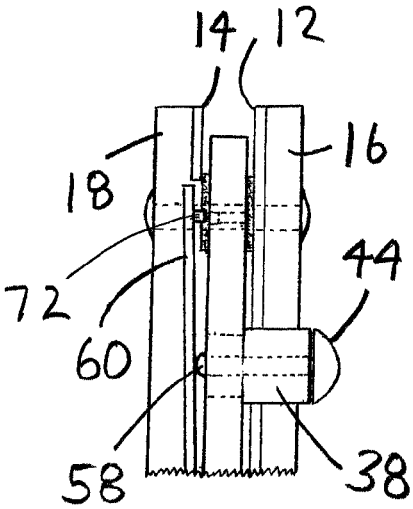
FIG. 14 is an enlarged view of a portion of FIG. 12 in accordance with the present invention.

With reference to FIGS. 8-10, a third embodiment of the thumb release knife 3 includes automatic opening. The thumb release knife 3 includes the knife blade 10, the first liner plate 12, the second liner plate 14, the first handle plate 16 and the second handle plate 18. A second end of the knife blade 10 is pivotally retained by the first end of the first and second liner plates. A spring spacer 108 is retained between the first and second liner plates at a second of the first and second liner plates. The spring spacer 108 includes a spring finger 110.

The spring finger 110 causes the knife blade 10 to rotate from a closed position to an open position, when the thumb disc 86 is rotated.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A folding knife, comprising:

at least one plate;

a knife blade having a first end pivotally retained by said at least one plate;

a spring arm being formed in one of said at least one plate, said spring arm having a free end and a first lock element formed in said free end;

a second lock element being formed in said knife blade, said first lock element engaging said second lock element when said knife blade is in a closed position; and an actuation device for moving said spring arm away from said knife blade and disengaging said first lock element from said second lock element, wherein said actuation device includes a button base, an actuation rod and a fastener, said button base includes a top bore, a through hole and a bottom bore, said button base is threaded into said knife blade, said actuation rod includes a push pad and a push rod that extends from a bottom of said push pad, said top bore is sized to slidably receive said push rod, said fastener is inserted through said bottom bore and said through hole and threaded into an end of said actuation rod, wherein a distance between a top of said button base and said bottom of said push pad is adjustable by the amount that said fastener is threaded into said push rod.

2. The folding knife of claim 1, further comprising:

said first lock element being one of a lock pin and a lock hole; and said second lock element being one of a lock hole and a lock pin.

3. The folding knife of claim 2, further comprising:

said means for moving being a thumb disc pivotally retained on said knife blade, said thumb disc being pivoted to move said lock pin out of said lock hole.

4. The folding knife of claim 1, further comprising:

at least one spring biasing arm for assisting the opening of said knife blade.

5. The folding knife of claim 1, further comprising:

a biasing mechanism for the automatic opening of said knife blade.

6. The folding knife of claim 1, further comprising:

a first handle plate being secured to an outside surface of a first plate, a second handle plate being secured to an outside surface of a second plate.

7. The folding knife of claim 1, further comprising:

a stop pin being retained in a first end of said at least one plate, a lock edge being formed on a second end of said knife blade, an end of one of said at least one plate engaging said lock edge.

8. A folding knife, comprising:

a first liner plate and a second liner plate;

a knife blade having a first end pivotally retained between a first end of said first and second liner plates;

a spring arm being formed in one of said first and second liner plates, said spring arm having a free end and a first lock element formed in said free end;

a second lock element being formed in said knife blade, said first lock element engaging said second lock element when said knife blade is in a closed position; and an actuation device for moving said spring arm away from said knife blade and disengaging said first lock element from said second lock element, wherein said actuation device includes a button base, an actuation rod and a fastener, said button base includes a top bore, a through hole and a bottom bore, said button base is threaded into said knife blade, said actuation rod includes a push pad and a push rod that extends from a bottom of said push pad, said top bore is sized to slidably receive said push rod, said fastener is inserted through said bottom bore and said through hole and threaded into an end of said actuation rod, wherein a distance between a top of said button base and said bottom of said push pad is adjustable by the amount that said fastener is threaded into said push rod.

9. The folding knife of claim 8, further comprising:

said first lock element being one of a lock pin and a lock hole; and said second lock element being one of a lock hole and a lock pin.

10. The folding knife of claim 8, further comprising:

said actuation device being a thumb disc pivotally retained on said knife blade, said thumb disc being pivoted to move said lock pin out of said lock hole.

11. The folding knife of claim 8, further comprising:

at least one spring biasing arm for assisting the opening of said knife blade.

12. The folding knife of claim 8, further comprising:

a biasing mechanism for the automatic opening of said knife blade.

13. A folding knife, comprising:

a handle;

a blade having a first end that is pivotally connected to said handle, said blade including a first lock element;

a spring arm disposed in said handle and having a free end that is biased against a side of said first end of said blade, said spring arm including a second lock element, wherein said second lock element is configured to engage said first lock element when said blade is in a closed position; and a user-engageable actuator disposed on said blade and configured to move said spring arm laterally away from said blade upon application of manual pressure on said actuator in order to remove said second lock element from engagement with said first lock element to permit pivoting of said blade from a closed position to an open position, wherein said actuator includes a button base and an actuation rod, said button base includes a bore, said button base is threaded into said knife blade, said actuation rod includes a push pad and a push rod that extends from a bottom of said push pad, said bore is sized to slidably receive said push rod, wherein application of manual pressure to said push pad is effective to move said push rod relative to said button base toward said spring arm and cause said spring arm to move laterally away from said blade.

14. The folding knife of claim 13, further comprising:

said first lock element being one of a lock hole and a lock pin; and said second lock element being one of a lock pin and a lock hole.

15. The folding knife of claim 14, further comprising:

said actuator being a thumb disc pivotally retained on said blade, said thumb disc being pivoted to move said lock pin out of said lock hole.

16. The folding knife of claim 13, further comprising:

at least one spring biasing arm for assisting the opening of said blade.

17. The folding knife of claim 13, further comprising:

a biasing mechanism for the automatic opening of said blade.

18. The folding knife of claim 13, wherein said actuator further includes a fastener that extends through said blade into said rod bore and is threaded into an end of said push rod opposite said push pad.

19. The folding knife of claim 18, wherein said fastener has an end that bears against said spring arm such that movement of said push rod toward said spring arm causes said fastener to push said spring arm laterally away from said blade.

20. The folding knife of claim 18, wherein a distance between a top of said button base and said bottom of said push pad is adjustable by the amount that said fastener is threaded into said push rod.

* * * * *